US005927662A

United States Patent [19]

West et al.

[11] Patent Number: 5,927,662

[45] Date of Patent: Jul. 27, 1999

[54] KEYBOARD SUPPORT WITH MULTI-POSITIONAL MOUSE PAD

[75] Inventors: Daniel C. K. West, Holland; Richard N. Roslund, Jr., Jenison, both of Mich.

[73] Assignee: Haworth, Inc., Holland, Mich.

[21] Appl. No.: 08/866,137

[22] Filed: May 30, 1997

[51] Int. Cl.[6] ..... B68G 5/00

[52] U.S. Cl. ..... 248/118; 248/918; 108/6; 108/28

[58] Field of Search ..... 248/118, 118.1, 248/118.3, 118.5, 918, 292.12; 108/6, 28, 59; 403/1, 4, 102, 165, 167, 194

[56] References Cited

U.S. PATENT DOCUMENTS

| | | | |
|---|---|---|---|
| 4,077,333 | 3/1978 | Ballas | 108/6 |
| 4,616,798 | 10/1986 | Smeenge et al. | 248/918 |
| 4,691,888 | 9/1987 | Cotterill | 248/918 |
| 4,863,124 | 9/1989 | Ball et al. | 108/28 |
| 4,956,929 | 9/1990 | Chirabandalsuk | 108/6 |
| 5,072,905 | 12/1991 | Hyatt | 248/918 |
| 5,342,006 | 8/1994 | Tice | 248/918 |
| 5,375,800 | 12/1994 | Wilcox et al. | 248/918 |
| 5,421,543 | 6/1995 | Rossman et al. | 248/918 |
| 5,429,337 | 7/1995 | Poole . | |
| 5,443,237 | 8/1995 | Stadtmauer . | |
| 5,509,628 | 4/1996 | Noble | 248/918 |
| 5,522,572 | 6/1996 | Copeland et al. | 248/918 |
| 5,564,667 | 10/1996 | Copeland et al. | 248/918 |
| 5,628,483 | 5/1997 | Smith et al. | 248/918 |
| 5,636,822 | 6/1997 | Hendershot et al. . | |
| 5,655,743 | 8/1997 | Gillis | 248/918 |
| 5,730,408 | 3/1998 | McAllister et al. | 248/918 |

FOREIGN PATENT DOCUMENTS 93 19 135 3/1994 Germany .

*Primary Examiner*—Ramon O. Ramirez
*Assistant Examiner*—Robert Lipcsik
*Attorney, Agent, or Firm*—Flynn, Thiel, Boutell & Tanis, P.C.

[57] ABSTRACT

A keyboard support arrangement which includes both a main support pad for a keyboard, and an auxiliary support pad for a mouse. The auxiliary support pad is removably and multiply positionable on and relative to the main support pad to provide increased convenience and flexibility of use with respect to the mouse support pad. The auxiliary pad is totally separable from the main pad, and a releasable and multi-positional connecting structure is provided for permitting the auxiliary pad to be mounted directly on the main pad adjacent either side edge thereof. The connecting structure also enables the auxiliary pad to be positioned relative to the main pad at one of many different angular relationships.

13 Claims, 6 Drawing Sheets

KEYBOARD SUPPORT WITH MULTI-POSITIONAL MOUSE PAD

FIELD OF THE INVENTION

This invention relates to a keyboard support arrangement for a computer and, more particularly, to an improved keyboard support arrangement employing separate keyboard and mouse support pads which are positionable in adjacent and interconnected relationship, with the mouse support pad being multi-positional relative to the keyboard support pad for improved convenience and flexibility of use.

BACKGROUND OF THE INVENTION

Numerous articulated keyboard mechanisms are mounted on and associated with work surfaces and similar desk tops to support a computer keyboard. These mechanisms are also often provided with an associated support pad for a mouse, although this associated support pad for the mouse is typically either integrally related to the keyboard support pad so as to have minimum flexibility, or in the alternative comprises a wholly independent mouse support pad which, while providing greater flexibility, nevertheless results in additional complications with respect to both structure and mounting.

It is an object of this invention to provide an improved keyboard support arrangement which accommodates both a keyboard and a mouse, but which greatly improves upon both the structure and the convenience and flexibility of use in comparison to known structures.

More specifically, the present invention relates to an improved keyboard support arrangement which includes both a main support pad for the keyboard, as well as an auxiliary support pad for the mouse, with the auxiliary support pad being removably and multiply positionable on and relative to the main support pad so as to provide greatly increased convenience and flexibility of use with respect to the mouse support pad and the mouse positionable thereon.

In the improved support pad arrangement of this invention, as aforesaid, the mouse or auxiliary pad is totally separable from the keyboard support pad, and a releasable and multi-positional connecting structure is provided for permitting the auxiliary pad to be mounted directly from the keyboard support pad adjacent either side edge thereof in accordance with the convenience and selection of the user. In addition, the connecting structure enables the auxiliary support pad to be positioned relative to the keyboard support pad at one of many different angular relationships so as to provide for increased comfort of position and use. The connecting structure also permits the auxiliary support pad to be totally and easily detached, and moved about as a portable unit, thereby enabling it to be carried about for use as a writing tablet or surface, or enabling it to be positioned on an adjacent desk top or work surface.

The improved arrangement of this invention, and specifically the structure of the pad arrangement and of the auxiliary mouse pad, possesses other advantageous structural and functional features which will be apparent upon reading the following specification and inspecting the accompanying drawings.

Figure 1:
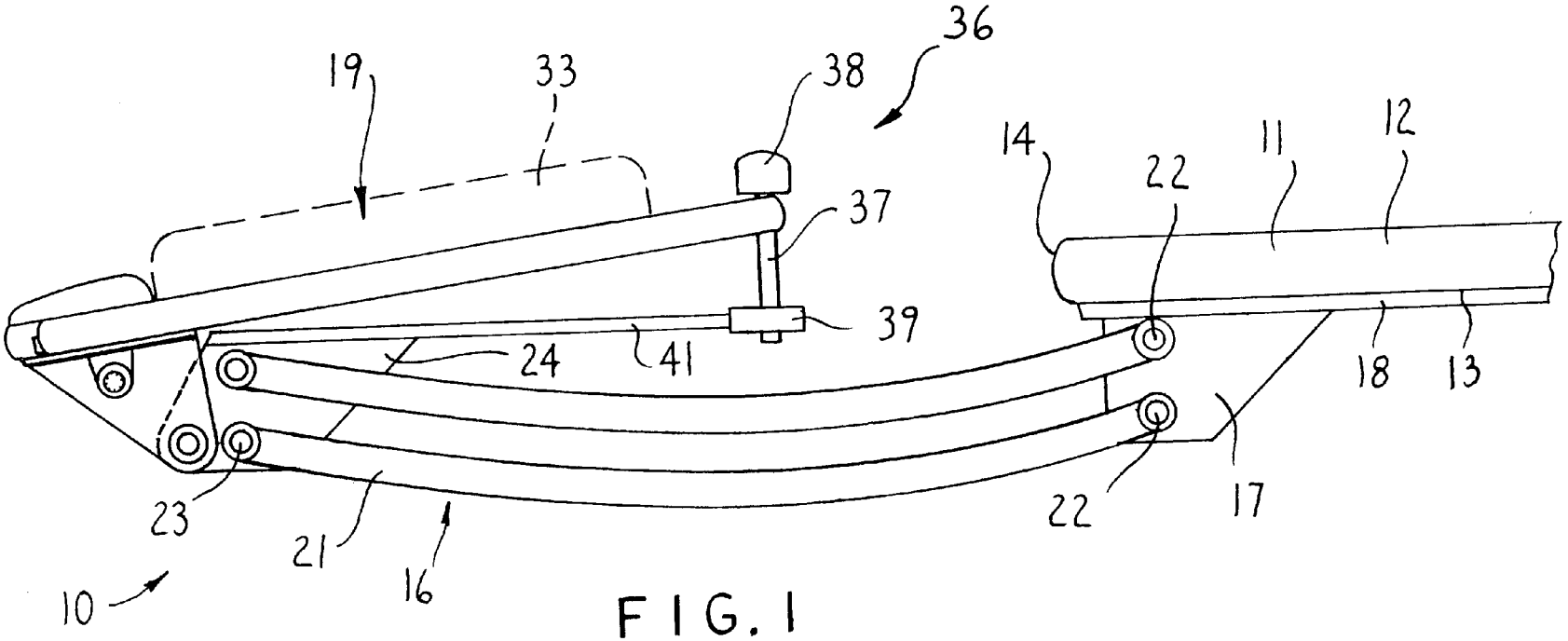
FIG. 1 is a side elevational view which illustrates the keyboard support arrangement of this invention and its attachment to and position adjacent a conventional work surface.

Certain terminology will be used in the following description for convenience and reference only, and will not be limiting. For example, the words "upwardly", "downwardly", "leftwardly" and "rightwardly" will refer to directions in the drawings to which reference is made. The word "upwardly" will refer to the upwardly facing surface of the pads, namely the surface on which the mouse and keyboard are typically supported. The word "front" will refer to that edge of the pad which is disposed most closely adjacent the keyboard operator, and the word "rear" will refer to the opposite edge. The words "inwardly" and "outwardly" will refer to directions toward and away from, respectively, the geometric center of the overall arrangement and designated parts thereof. Said terminology will include the words specifically mentioned, derivatives thereof, and words of similar import.

DETAILED DESCRIPTION

Referring to the drawings, there is illustrated an articulated keyboard support arrangement 10 according to the present invention. This arrangement is adapted to be mounted on a conventional work surface or table top 11, the latter having upper and lower generally horizontal and substantially planar upper and lower surfaces 12 and 13, respectively, with the work surface also typically terminating in a free front edge 14.

The keyboard support arrangement in the illustrated embodiment includes an elongate support arm 16 which at one end couples to a bracket or carriage 17 which is positionable under the work surface and is connected thereto in a conventional manner. In the illustrated embodiment the carriage is confined for sliding movement in a front-to-back direction of the work surface by means of a suitable track 18. The other or forward end of the support arm 16 in turn mounts thereon a pad assembly 19.

The overall arrangement as described above, and specifically the construction of the arm 16 and carriage 17 may assume any desirable configuration, and one conventional such configuration is illustrated in U.S. Pat. No. 4,616,798, as owned by the assignee hereof.

The support arm 16 in the illustrated embodiment is defined by a plurality of elongate rods 21 which at their remote ends are joined by substantially horizontal pivots 22 to the carriage 17, and at their other ends are joined by horizontal pivots 23 to a bracket or mounting structure 24, the latter being part of the pad assembly 19. The pivot arrangement defined by the rods 21 effectively define a vertically-oriented four-bar linkage which may approach a parallelogram so that the entire pad assembly 19 can be vertically raised and lowered to a suitable height by upward and downward swinging of the elongate support arm about the pivots 22. By maintaining a substantially parallelogram linkage, vertical swinging of the support arm still results in the pad assembly 19 maintaining the upper surfaces thereof in substantially the same orientation.

Considering now the construction of the pad assembly 19, same includes a main keyboard support pad 31 which has a generally horizontally enlarged and substantially planar upper surface 32 for supporting a conventional computer keyboard 33 thereon. This pad 31 mounts thereon a downwardly projecting bracket or support 34 which is joined by means of a transversely-projecting horizontal pivot 35 to the bracket or mounting 24. This pivot 35 is substantially parallel to the pivots 22 and 23 and enables the pad 31 to be vertically tilted into a desired position about the pivot axis 35 when the support arm 16 is in a stationary position.

The overall support arrangement 10 also includes a tilt lock 36 for permitting adjustment in the position of the pad 19 and securement thereof in the adjusted position. This tilt lock 36 includes an adjustment screw 37 which is firmly engaged with the pad 31 adjacent the rear edge thereof. This screw projects upwardly and has an enlarged knob or gripping part 38 thereon, and the lower end of the threaded adjustment screw 37 projects downwardly below the pad and is axially secured but rotatably engaged with a control plate 39 which in turn is generally captivated on the rearward end of a lever 41 which projects forwardly and is rigidly joined to the bracket 24.

The main keyboard pad 31 is also preferably provided with an elongate wrist rest 42 disposed adjacent and extending along the front edge of the pad. This wrist rest 42 is preferably an elongate foamed cushion which may be supported directly on the pad 31 in the vicinity of the front edge thereof so as to project upwardly above the upper surface 32, whereby the wrist rest defines an upwardly projecting abutment surface 44 on the rear edge thereof, the latter functioning to confine the keyboard on the pad. This wrist rest 42 is preferably adjustable in height to suit the individual operator, and for this purpose may be provided with plate-like cams or wedges 45 disposed between the wrist rest and the keypad, the latter having suitable knobs 46 associated therewith and projecting outwardly from the front of the pad 31 adjacent the corners thereof so as to permit manual adjustment in the height of the wrist rest by sliding the cams sidewardly as indicated by the arrow.

The pad assembly 19 also includes an auxiliary pad 51 which is provided for permitting optimum support and operation of a computer mouse (not shown) thereon. This auxiliary pad 51 includes a generally horizontally enlarged and substantially planar upper surface 52 which has a suitable smoothness and softness so as to provide optimum support and performance for a conventional computer mouse.

Figure 2:
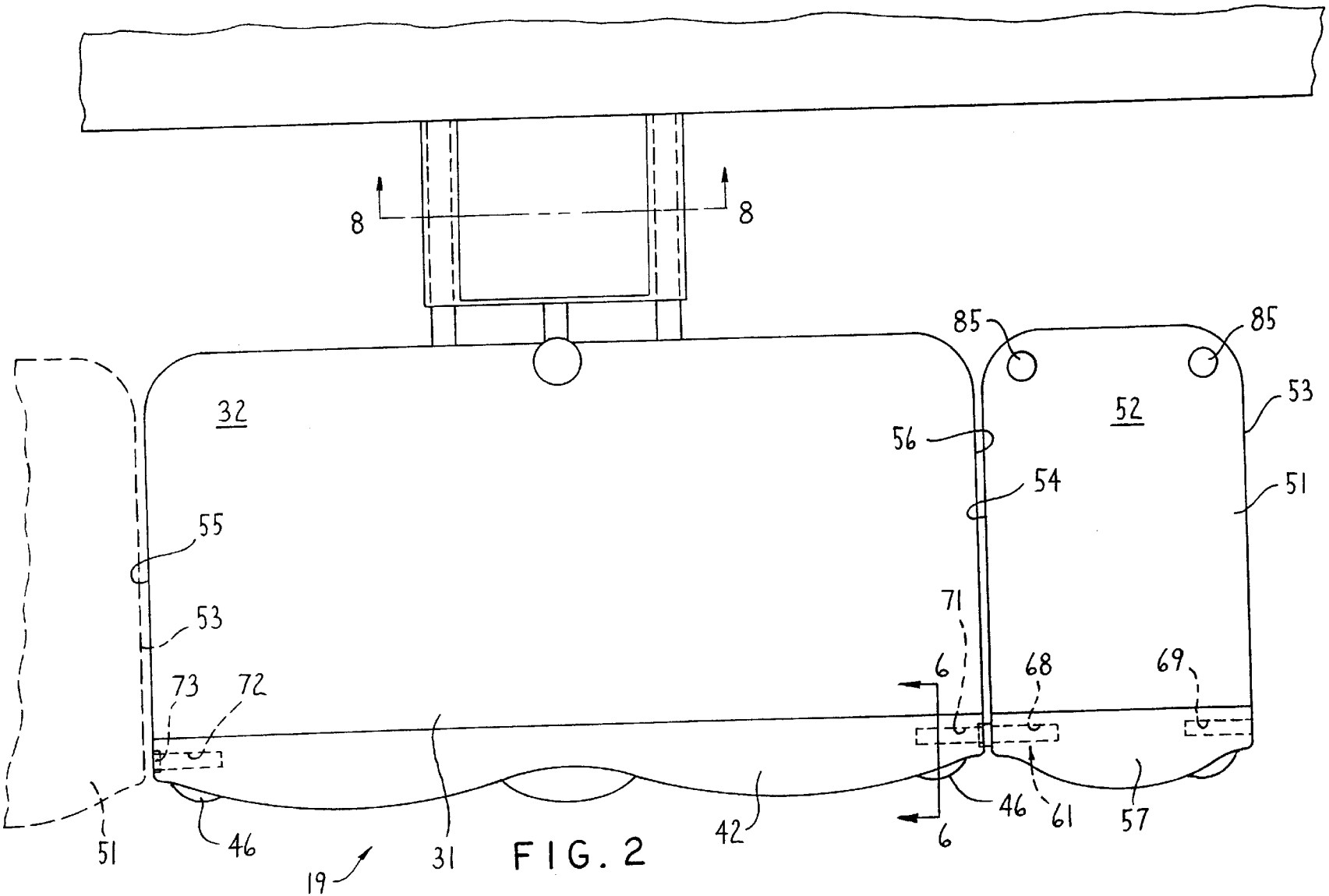
FIG. 2 is an enlarged top view which illustrates primarily the pad assembly as defined by the separate keyboard and mouse pads.
Figure 3:
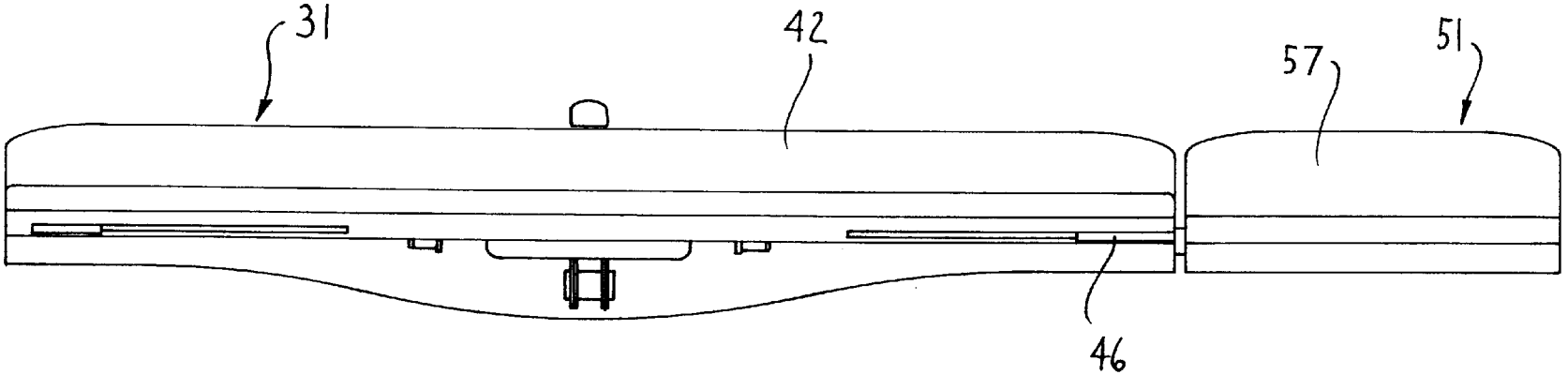
FIG. 3 is an elevational view which illustrates the front edge of the pad arrangement shown in FIG. 2.
Figure 4:
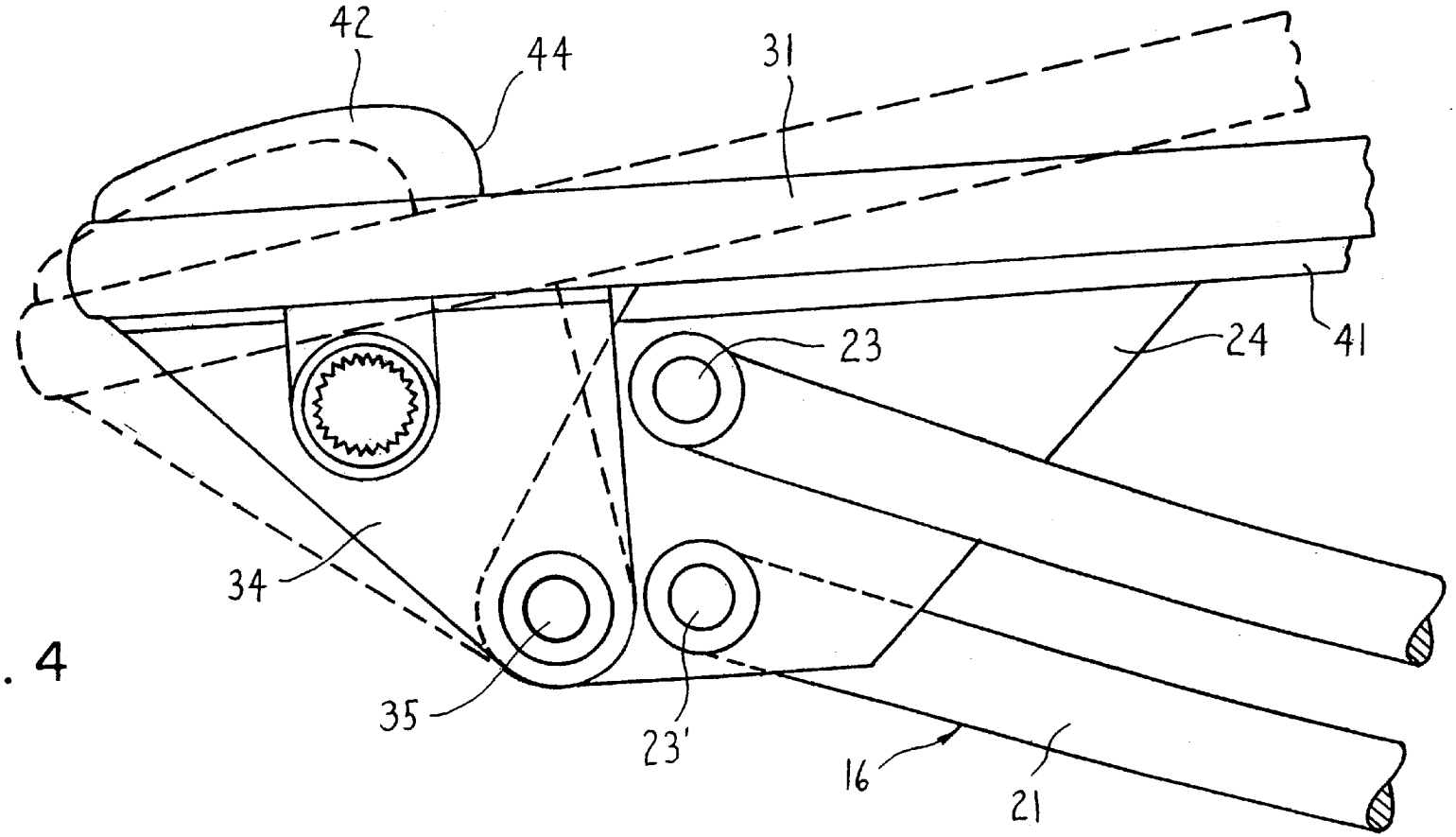
FIG. 4 is an enlarged, fragmentary right side elevational view of the keyboard pad arrangement shown in FIG. 2.

The auxiliary or mouse pad 51 has right and left side edges 53 and 54 which are configured so as to be positionable adjacent and compatible with respective corresponding left and right side edges 55 and 56 of the main keyboard pad 31. That is, the edges 54 and 56 are of corresponding and complementary configuration so as to be positionable directly adjacent one another substantially as shown in FIG. 2, or alternatively the remaining edges 53 and 55 are also of similar and complementary configuration so as to be positionable directly adjacent one another. In the illustrated embodiments, all of the side edges are substantially straight and parallel so that the auxiliary pad 51 can be disposed closely adjacent the right side of the main pad as shown in FIG. 2, or alternatively the auxiliary pad can be positioned directly adjacent the left side of the main pad, as indicated by fragmentary broken lines in FIG. 2.

The auxiliary pad 51 also preferably has a wrist rest 57 secured adjacent the front edge thereof, which wrist rest also preferably projects upwardly and is preferably of a soft (i.e. foamed) cushion construction. The wrist rest 57 and its mounting on the auxiliary pad is generally the same as the construction of the wrist pad and the mounting thereof on the main keyboard pad 31.

The auxiliary pad 51 of this invention is detachably and multi-positionally mountable directly on the main keyboard pad 31 by means of a detachable connector structure 61. The latter includes an elongate connecting element 62 which is totally separable from both of the pads 31 and 51. This connecting element 62 includes an elongate rod 63 which in turn rigidly joins to a further elongate rod 64, which rods are generally coaxially aligned, and are provided with a radially enlarged intermediate mounting hub 65 where the rods 63 and 64 join. The rod 63 will typically be of cylindrical cross-section, whereas the rod 64 will typically have a keyed or non-circular cross-section. The enlarged mounting hub 65, which is disposed generally at the middle or intermediate the free ends of the connecting element 62, has a multi-sided outer peripheral configuration, such as a serrated or toothed configuration, whereby this enables the connecting element 62 to be non-rotatably positioned in a plurality of different angularly-displaced positions, as explained hereinafter.

To permit the connecting element 62 to cooperate with the pads 31 and 51, the auxiliary pad 51 has a pair of generally coaxially aligned and elongate bores 68 and 69 opening inwardly from opposite side edges 54 and 53 thereof, which bores can be defined by a continuous through opening if desired. These bores hence define an axis which is positioned closely adjacent the front edge of the auxiliary pad, and in fact is preferably positioned under the wrist rest, being disposed forwardly from the rear edge of the wrist rest as illustrated by FIG. 2. The bores 68 and 69 each have a keyed or non-circular cross-section which corresponds generally to the cross-section of the elongate rod 64. The rod 64 is slidably inserted into the opening 68 when the pad 51 is disposed adjacent the right side of the keyboard pad 31. Similarly, the rod 64 is slidably inserted into the other opening 69 when the auxiliary pad 51 is positioned adjacent the left side of the keyboard pad 31. The non-circular cross-sections of the rod 64 and bores 68–69 thus provide a non-rotatable securement of the pad 51 to the elongate connecting element 62.

The main keyboard pad 31 is also provided with generally coaxially aligned bores or openings 71 and 72 formed therein, which openings open inwardly from the respective side edges 56 and 55 and are also disposed adjacent the front edge of the pad 31, the openings 71 and 72 in the illustrated embodiment being disposed substantially directly under the wrist rest 42. The openings 71 and 72 may have a cylindrical configuration corresponding to the rod 63 so as to enable the latter to be rotatable therein if desired.

Figure 5:
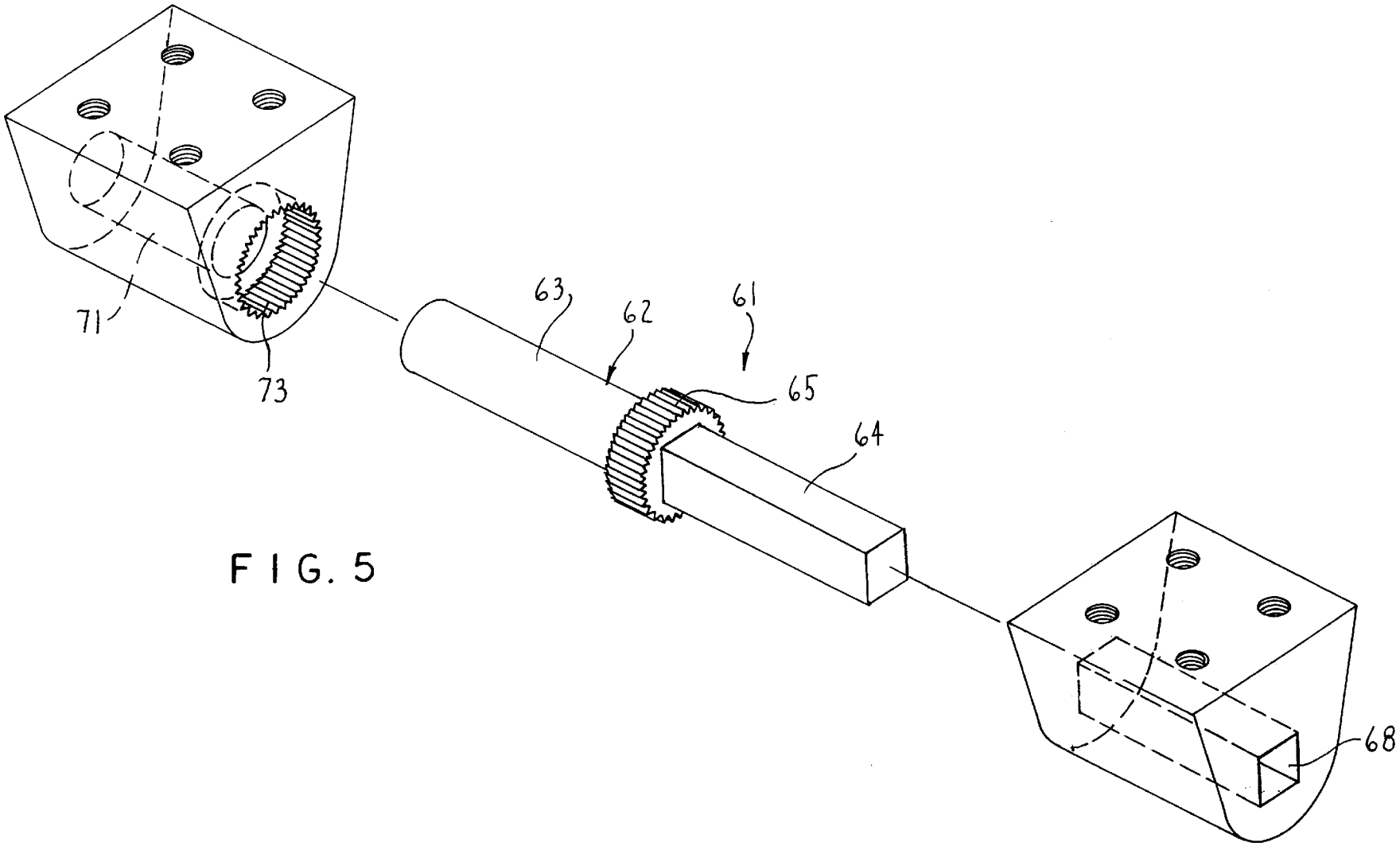
FIG. 5 is an exploded view showing the connecting structure between the keyboard and auxiliary pads.
Figure 8:
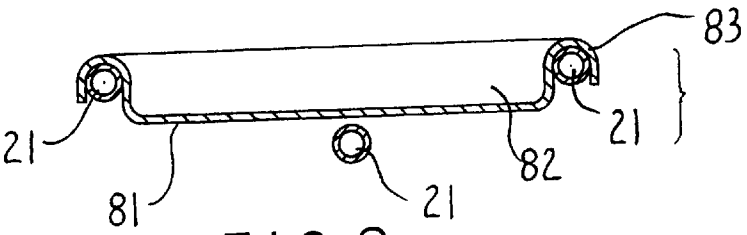
FIG. 8 is a sectional view taken generally along line 8—8 in FIG. 2.
Figure 6:
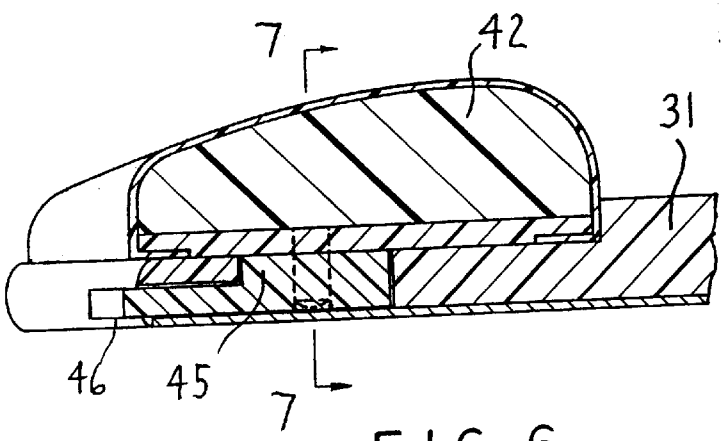
FIG. 6 is an enlarged sectional view taken generally along line 6—6 in FIG. 2.
Figure 7:
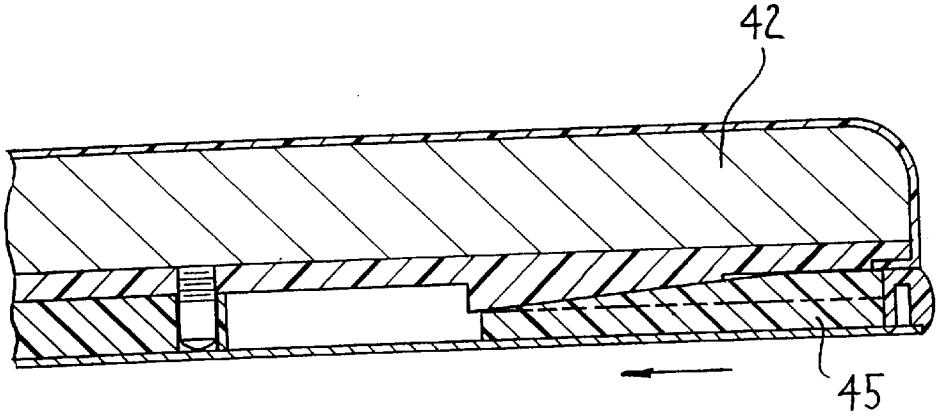
FIG. 7 is a sectional view taken generally along line 7—7 in FIG. 6.

As shown in FIG. 5, the bores 68–69 and 71–72 can be defined in small blocks or members which fixedly attach to the underside of the respective pad adjacent the front corners thereof.

Each opening 71 and 72, adjacent the free end thereof, is provided with an enlarged bore 73 which opens inwardly a limited distance from the adjacent side edge of the keyboard pad. This enlarged bore 73 has a non-circular or keyed exterior wall (i.e., toothed or serrated) which defines a plurality of closely adjacent angular positional relationships, with the wall of this bore 73 generally corresponding to the exterior wall of the hub 65 on the connecting element 62. Due to this non-circular configuration of the hub 65 and bore 73, namely a serrated or closely adjacent toothed configuration, this enables the connecting element 62 and the mouse pad 51 mounted thereon to be inserted into the respective opening 71 or 72 at one of many different angular relationships relative to the keyboard pad 31, with the engagement of the hub 65 within the bore 73 then maintaining at least a fixed angular relationship between the pads 31 and 51. In this manner the operator can readily position the mouse pad 51 either generally coplanar with or at any one of several different angled relationships with respect to the keyboard pad 31. This also enables the operator to readily change the angled relationship of the mouse pad 51 merely by moving the mouse pad 51 and connecting element 62 sidewardly a sufficient extent to disengage the toothed hub 65 from the bore 73, pivoting the mouse pad 51 into the desired position, and then reinserting the toothed hub 65 back into the bore 73 to lock the mouse pad 51 in the newly selected angular orientation.

Since the connecting element 62 is disposed closely adjacent the front edge of the pads 31 and 51, and in fact is positioned forwardly from the rear edge of the wrist rest, this thus results in the main upper planar surface area of the pad 51, as defined rearwardly of the wrist rest, being disposed so as to always be substantially co-planar with or angled upwardly relative to the adjacent upper surface of the keyboard pad 31, thereby providing for convenient positioning and hence convenient operation of the mouse which is typically used on the pad 51.

The mouse pad 51 is preferably provided of a layered or laminated construction and may be defined by a generally enlarged base plate having an upper transparent layer disposed thereover and defining the upper mouse-engaging surface. This upper transparent layer can be suitably removable so as to permit notes and other information to be positioned and securely maintained between the layers, thereby providing convenient visibility for the operator.

Due to the ease with which the mouse pad 51 can be mounted on and interchanged from either a right side to a left side position relative to the keyboard pad 31, or in fact detached totally from the keyboard pad 31, the mouse pad 51 hence can be readily used for other purposes or conveniently repositioned. For example, the mouse pad 51 can be easily detached from the keyboard pad 31 and positioned on an adjacent work surface or desk top if the operator so desires. Alternately the mouse pad, when detached, can be carried about and used as a writing tablet or support.

If desired, the support arm associated with the arrangement may have a tool tray 81 mounted thereon. This tool tray 81 is a shallow upwardly opening box-like structure which defines therein an upwardly opening compartment 82 for accommodating therein pens and similar utensils used by an operator. The side walls of the tool tray 81 have downwardly opening hooks or channels 83 extending along and projecting outwardly from the opposite upper edges thereof. These hooks or channels 83 are intended to drop down and hence engage over the upper rods 21 associated with the support arm, whereby the tool tray is positionable at a convenient location between the support rods at a location directly adjacent but rearwardly from the rear edge of the keyboard tray 31.

The removable mouse pad 51 can also be provided with a structure associated with the underside thereof which enables the pad 51, when removed from the keyboard pad, to be supported on a separate work surface in a generally upright relation so as to permit its use as a paper support or the like. For this purpose, the rear of the mouse pad 51 can be provided with a collapsible support arm similar to a conventional portable picture frame.

The mouse pad 51 can also be provided with support feet 85 adjacent the upper corners thereof, the latter being threaded into and projecting downwardly from the underside of the mouse pad. Such feet can be manually adjusted downwardly by an operator when the mouse pad is removed from the keyboard pad and is supported on a separate work surface, thereby enabling some adjustment in the angular orientation of the mouse pad relative to the supporting work surface.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A support pad arrangement for a computer keyboard, comprising:

a main keyboard support pad having a generally horizontally enlarged upper surface adapted for supporting the keyboard thereon;

an auxiliary support pad defining thereon a generally horizontally enlarged upper surface adapted for supportive engagement with a computer mouse;

a supporting structure for movably supporting said pad arrangement from a work surface, said supporting structure having a first end connected to said main pad and a second end connected to the work surface, and said supporting structure being free of connection to said auxiliary support pad; and a multi-positional connecting structure directly connecting said auxiliary pad to said main support pad and defining a generally horizontal pivot axis, said connecting structure being configured and disposed to permit ready removal and separation of said auxiliary pad from a first side of said main support pad and ready reattachment of said auxiliary pad to a second side of said main support pad, said connecting structure including first and second connecting members respectively mounted on said first and second sides of said main pad, and a third connecting member associated with said auxiliary pad, said third connecting member being configured to cooperatively engage with one of said first and second connecting members to create a plurality of discrete angular positions of said auxiliary pad with respect to said main pad by pivoting said auxiliary pad about the pivot axis when said auxiliary pad is positioned adjacent said first and second sides, respectively.

2. An arrangement according to claim 1, wherein each of said main and auxiliary pads mounts a cushioned wrist rest thereon adjacent the front edge thereof and projecting upwardly from the upper surface thereof.

3. An arrangement according to claim 1, wherein said connecting structure includes an elongate connecting element which has a first elongate connecting portion which is slidably supportable on said main pad and a second elongate connecting portion which is releasably and slidably engagable with said auxiliary pad.

4. An arrangement according to claim 3, wherein said first and second connecting portions are generally aligned with one another and permit the pads to be disposed in closely adjacent and side by side relation with one another with said connecting element being joined therebetween.

5. A support pad arrangement for a computer keyboard, comprising:

a main keyboard support pad having a generally horizontally enlarged upper surface adapted for supporting the keyboard thereon;

an auxiliary support pad defining thereon a generally horizontally enlarged upper surface adapted for supportive engagement with a computer mouse, said auxiliary support pad being wholly separable from said main support pad;

a supporting structure connected to said main support pad for movably supporting said pad arrangement from a work surface, said supporting structure being free of connection to said auxiliary support pad; and a multi-positional connecting structure detachably and directly connecting said auxiliary pad to said main support pad for permitting said auxiliary pad to be positioned directly adjacent at least one side of said main support pad and supported directly therefrom;

said connecting structure defining a generally horizontal pivot axis and including a first toothed connecting member non-rotatably associated with said main support pad and a second toothed connecting member non-rotatably associated with said auxiliary pad, said second toothed connecting member being configured to cooperatively mate with said first toothed connecting member and being pivotable about the pivot axis along with said auxiliary pad to enable positioning of said auxiliary support pad in a plurality of different angular relationships relative to the main support pad.

6. An arrangement according to claim 5, wherein the pivot axis of said connecting structure extends transversely of said main and auxiliary pads.

7. An arrangement according to claim 6, wherein said connecting structure includes an elongate connecting element which has a first elongate connecting portion which is slidably supportable on said main pad and a second elongate connecting portion which is releasably engagable with said auxiliary pad.

8. An arrangement according to claim 7, wherein said first and second connecting portions are elongated and generally aligned with one another and are disposed to permit the pads to be positioned in closely adjacent and side by side relation with one another with said connecting element being joined therebetween.

9. A support pad arrangement for a computer keyboard, comprising:

a main keyboard support pad having a generally horizontally enlarged upper surface adapted for supporting the keyboard thereon;

an auxiliary support pad defining thereon a generally horizontally enlarged upper surface adapted for supportive engagement with a computer mouse;

a supporting structure connected to said main support pad for movably supporting said pad arrangement from a work surface, said supporting structure being free of connection to said auxiliary support pad; and a multi-positional connecting structure directly connecting said auxiliary pad to said main support pad, said connecting structure being configured and disposed to permit removal and separation of said auxiliary pad from a first side of said main support pad and reattachment of said auxiliary pad to a second side of said main support pad, said connecting structure including first and second connecting members each having a toothed portion and being respectively mounted on said first and second sides of said main pad, and a third connecting member associated with said auxiliary pad said third connecting member having a toothed portion configured to cooperatively engage with said toothed portion of one of said first and second connecting members to create a plurality of discrete annular positions of said auxiliary pad with respect to said main pad when said auxiliary pad is positioned adjacent said first and second sides, respectively.

10. An arrangement according to claim 9 wherein said connecting structure defines a generally horizontal pivot axis and said auxiliary pad is slidably movable in a direction parallel to the pivot axis and away from said main pad to disengage said toothed portion of said third connecting member from said toothed portion of said one first and second connecting member and permit pivoting movement of said auxiliary pad about the pivot axis to a desired angular position with respect to said main pad, and said auxiliary pad is slidably movable in a direction toward said main pad to re-engage said toothed portion of said third connecting member with said toothed portion of said one first and second connecting member and lock said auxiliary pad in the desired angular position with respect to said main pad.

11. A support pad arrangement for a computer keyboard, comprising:

a main keyboard support pad having a generally horizontally enlarged upper surface adapted for supporting the keyboard thereon, said main pad having front and rear edges and first and second side edges extending transversely between and interconnecting said front and rear edges;

an auxiliary support pad defining thereon a generally horizontally enlarged upper surface adapted for supportive engagement with a computer mouse, said auxiliary pad being wholly separable from said main pad;

a supporting structure connected to said main pad and projecting transversely from said front edge thereof for movably supporting said pad arrangement from a work surface, said supporting structure being free of connection to said auxiliary pad; and a connecting structure configured to directly and detachably connect said auxiliary pad to said main pad adjacent either of said first and second side edges and defining a generally horizontal pivot axis which extends transversely of said first and second side edges, said connecting structure including an elongate support element having a first end slidably supported on said main pad and slidably movable relative thereto in a direction substantially parallel to the pivot axis, and a second end associated with said auxiliary pad, and a locking arrangement cooperating between said main and auxiliary pads configured to permit said auxiliary pad to be positioned in a plurality of discrete and fixed angular positions with respect to said main pad by pivoting of said auxiliary pad about the pivot axis.

12. A support pad arrangement according to claim 11 wherein said locking arrangement includes first and second connecting members mounted adjacent said first and second side edges of said main pad, respectively, and a third connecting member associated with said auxiliary pad configured to cooperatively engage with one of said first and second connecting members to provide the plurality of discrete angular positions of said auxiliary pad with respect to said main pad.

13. A support pad arrangement according to claim 11 wherein said auxiliary pad mounts a cushioned wrist rest thereon adjacent a front edge thereof and projecting upwardly from said upper surface thereof.

* * * * *